US010312616B2

(12) United States Patent
Tan

(10) Patent No.: US 10,312,616 B2
(45) Date of Patent: Jun. 4, 2019

(54) CARD EDGE CONNECTOR

(71) Applicant: Molex, LLC, Lisle, IL (US)

(72) Inventor: Chin Guan Tan, Singapore (SG)

(73) Assignee: Molex, LLC, Lisle, IL (US)

( * ) Notice: Subject to any disclaimer, the term of this patent is extended or adjusted under 35 U.S.C. 154(b) by 0 days.

(21) Appl. No.: 16/034,121

(22) Filed: Jul. 12, 2018

(65) Prior Publication Data

US 2019/0020141 A1 Jan. 17, 2019

(30) Foreign Application Priority Data

Jul. 14, 2017 (CN) ..... 2017 1 0574511

(51) Int. Cl.
*H01R 12/73* (2011.01)
*H01R 13/11* (2006.01)
*H01R 12/57* (2011.01)

(52) U.S. Cl.
CPC ..... *H01R 12/737* (2013.01); *H01R 12/57* (2013.01); *H01R 13/112* (2013.01)

(58) Field of Classification Search
CPC ..... H01R 12/737
See application file for complete search history.

(56) References Cited

U.S. PATENT DOCUMENTS 4,832,617 A 5/1989 Brown
5,074,039 A * 12/1991 Hillbish ..... H01R 43/16 29/883
5,520,545 A * 5/1996 Sipe ..... H01R 13/28 439/65
2010/0159723 A1* 6/2010 Tan ..... H01R 13/62988 439/153
2016/0069547 A1* 3/2016 Chen ..... F21V 21/002 362/652
2016/0181713 A1 6/2016 Peloza et al.

* cited by examiner

*Primary Examiner* — James Harvey
(74) *Attorney, Agent, or Firm* — Molex, LLC

(57) ABSTRACT

A card edge connector comprising a plurality of flat plate-shaped terminals, each of which comprises an elastic arm portion. The elastic arm sequentially comprises a lower reverse bent section, an outward inclined arm section, an upper reverse bent section and an inward inclined arm section. The elastic arm is a two-arm configuration with a closed loop, the two-arm configuration has an inner arm and an outer arm. The inner arm and the outer arm each have the corresponding lower reverse bent section, the corresponding outward inclined arm section, the corresponding upper reverse bent section and the corresponding inward inclined arm section. The width of the upper reverse bent section of the inner arm is the largest among the sections of the inner arm and the sections of the outer arm. Because the upper reverse bent section has the largest width, it can prevent excessive deflection of the flat plate-shaped terminal.

15 Claims, 11 Drawing Sheets

3

3

CARD EDGE CONNECTOR

RELATED APPLICATIONS

This application claims priority to Chinese Application No. 201710574511.8, filed Jul. 14, 2017, which is incorporated herein by reference in its entirety.

TECHNICAL FIELD

The present disclosure relates to a card edge connector, especially to a card edge connector used for assembling a card edge module.

BACKGROUND ART

FIG. 1 is a structural schematic view of a terminal 11 of an existing card edge connector which is disclosed in U.S. Pat. No. 4,832,617 (corresponding to Taiwanese patent application No. TW77211193). Referring to FIG. 1, the terminal 11 is a terminal in form of a planar conductive member, which has a central cutout 10 to form planar beam sections 12A and 12B generally parallel to each other and spaced apart from each other, and ends of the planar beam sections 12A and 12B away from the base 14 are connect together at a part 16. The planar beam sections 12A and 12B both have uniform and identical widths (i.e., a width W0 of the planar beam section 12A is the same as a width W0' of the planar beam section 12B) along a length direction, the central cutout 10 is positioned between adjacent edges of the two planar beam sections 12A and 12B, and has a width which is substantially the same as the width of each of the planar beam sections 12A and 12B. One of the planar beam sections 12A and 12B is subjected to a tensile force, and the other of the planar beam sections 12A and 12B is subjected to a compressive force.

Since the widths of the generally parallel planar beam sections 12A and 12B of the terminal 11 are the same, a stress applied by the board 18 to the planar beam sections 12A and 12B is relatively easy to exceed a stress that the planar beam section 12A and 12B can bear when a board card 18 is inserted in or pulled out, thereby causing the permanent deformation of the terminal 11, especially such a permanent deformation more easily occur at bending locations of the two planar beam sections 12A and 12B. The tensile forces and compressive forces to which the planar beam sections 12A and 12B are subjected are different, of course, one way is to increase the widths and thicknesses of the planar beam section 12A and 12B at the same time to overcome the maximum plastic deformation of the planar beam section 12A and 12B, but if it does so, the connector and terminal will be difficult to design smaller and more compact.

FIG. 2 is a structural schematic view of terminals 2A and 2B of an existing card edge connector which is disclosed in Chinese patent application No. CN201480045224.2 (corresponding to United States patent publication No. US2016/0181713 and Taiwanese patent application No. TW103127051). Referring to FIG. 2, a terminal 2A comprises a contact portion 20A, and a terminal 2B comprises a contact portion 20B. The contact portions 20A and 20B are formed as a loop and comprise back frames 22A and 22B which help support the contact portions 20A and 20B.

However, similarly, since a width of the contact portion 20A of the terminal 2A is the same as a width of the contact portion 20B of the terminal 2B, the stresses applied by the board card to the contact portion 20A of the terminal 2A and the contact portion 20B of the terminal 2B are relatively easy to respectively exceed stresses that the contact portion 20A of the terminal 2A and the contact portion 20B of the terminal 2B can bear when a board card (not shown) is inserted into or pulled out, thereby causing the permanent deformation of the terminal 2A and the permanent deformation of the terminal 2B, and such a permanent deformation is more easily occur respectively at bending locations of the terminal 2A and the terminal 2B.

The description in background as above merely is used to provide a background art, and it does not admit that the description on the background art as above discloses the object of the present disclosure, and do not constitute a prior art of the present disclosure, and any description in background as above shall not be acted as any part of the present disclosure.

SUMMARY

The embodiments of the present disclosure provide a card edge connector. The card edge connector comprises an insulating housing and a plurality of flat plate-shaped terminals. The insulating housing is formed as an elongated shape extending along a longitudinal direction, the insulating housing has a top surface and a bottom surface which define an up-down direction, the insulating housing has a card edge inserting groove on the top surface along the longitudinal direction, the card edge inserting groove separates the insulating housing into a first wall body and a second wall body, a direction that the first wall body and the second wall body face each other defining a transversal direction, a direction that each of the first wall body and the second wall body faces the card edge inserting groove is an inner direction, and a direction that each of the first wall body and the second wall body is away from the card edge inserting groove is an outer direction, at least one of the first wall body and the second wall body has a plurality of terminal grooves which are arranged side by side in the longitudinal direction and each are provided in the transversal direction. Each flat plate-shaped terminal is mounted in the corresponding terminal groove, an extending direction of a plate surface of each flat plate-shaped terminal is parallel to the transversal direction, each flat plate-shaped terminal comprises a base portion, a contact portion and an elastic arm portion. The base portion is positioned at a lower side of the flat plate-shaped terminal. The contact portion is positioned above the base portion and extends into the card edge inserting groove. The elastic arm portion is positioned between the base portion the contact portion, the elastic arm portion sequentially comprises a lower reverse bent section, an outward inclined arm section, an upper reverse bent section and an inward inclined arm section. The lower reverse bent section connects the base portion, extends from the base portion toward the inner direction, reversely bends, and extends toward the outer direction and an inclined upward direction. The outward inclined arm section extends toward the outer direction and the inclined upward direction. The upper reverse bent section reversely bends and extends toward the inner direction and an inclined downward direction. The inward inclined arm section extends toward the inner direction and the inclined downward direction. The elastic arm portion is a two-arm configuration with a closed loop, the two-arm configuration has an inner arm and an outer arm, the inner arm and the outer arm are arranged along an overall profile of each flat plate-shaped terminal and have different profiles, the inner arm and the outer arm each have the corresponding lower reverse bent section, the corresponding outward inclined arm section, the corresponding upper reverse bent section and the corresponding inward inclined arm section which respectively correspond to the sections of the elastic arm portion.

In the embodiments of the present disclosure, the outward inclined arm section of the outer arm is spaced apart from the outward inclined arm section of the inner arm by a first spacing, the upper reverse bent section of the outer arm is spaced apart from the upper reverse bent section of the inner arm by a second spacing, the inward inclined wall section of the outer arm is spaced apart from the inward inclined wall section of the inner arm by a third spacing, and the second spacing is larger than the first spacing and the third spacing.

In the embodiments of the present disclosure, a thickness refers to a plate thickness of each flat plate-shaped terminal, and a width refers to a width of each section of each flat plate-shaped terminal along a plate surface direction. The width of the upper reverse bent section of the inner arm is the largest among the sections of the inner arm and the sections of the outer arm, the width of the lower reverse bent section of the inner arm is the smallest among the sections of the inner arm, and the width of the lower reverse bent section of the outer arm is the smallest among the sections of the outer arm, the width of the lower reverse bent section of the inner arm is larger than or equal to the width of the lower reverse bent section of the outer arm, the width of the outward inclined arm section of the inner arm is larger than or equal to the width of the outward inclined arm section of the outer arm, the width of the inward inclined arm section of the inner arm is larger than or equal to the width of the inward inclined arm section of the outer arm.

In the embodiments of the present disclosure, the second spacing is larger than the first spacing, and the first spacing is larger than the third spacing.

In the embodiments of the present disclosure, the width of the lower reverse bent section of the inner arm is equal to the width of the lower reverse bent section of the outer arm.

In the embodiments of the present disclosure, a ratio of the width of the inner arm to the thickness of the inner arm range from 1.3 to 2.3, and a ratio of the width of the outer arm to the thickness of the outer arm range from 1.3 to 2.3.

In the embodiments of the present disclosure, the contact portion has a contact edge and a guide edge, the guide edge is positioned above the contact edge. The plurality of flat plate-shaped terminals comprise a first row of flat plate-shaped terminals and a second row of flat plate-shaped terminal, each flat plate-shaped terminal of the first row is mounted in each terminal groove of the first wall body, each flat plate-shaped terminal of the second row is mount in each terminal groove of the second wall body. A height of the contact portion of each flat plate-shaped terminal of the first row is lower than a height of the contact portion of each flat plate-shaped terminal of the second row. A sharp angle between the guide edge of each flat plate-shaped terminal of the first row and the up-down direction is larger than a sharp angle between the guide edge of each flat plate-shaped terminal of the second row and the up-down direction. The width of the upper reverse bent section of the inner arm of each flat plate-shaped terminal of the first row is larger than the width of the upper reverse bent section of the inner arm of each flat plate-shaped terminal of the second row.

In the embodiments of the present disclosure, the width of the inward inclined arm section of the inner arm of each flat plate-shaped terminal of the second row is larger than the width of the inward inclined arm section of the inner arm of each flat plate-shaped terminal of the first row. The width of the inward inclined arm section of the outer arm of each flat plate-shaped terminal of the first row is equal to the width of the upper reverse bent section of the outer arm of each flat plate-shaped terminal of the first row, the width of the inward inclined arm section of the outer arm of each flat plate-shaped terminal of the second row is equal to the width of the upper reverse bent section of the outer arm of each flat plate-shaped terminal of the second row, the width of the inward inclined arm section of the outer arm of each flat plate-shaped terminal of the first row is larger than the width of the inward inclined arm section of the outer arm of each flat plate-shaped terminal of the second row. The width of the outward inclined arm section of the inner arm of each flat plate-shaped terminal of the first row is larger than or equal to the width of the outward inclined arm section of the inner arm of each flat plate-shaped terminal of the second row. The width of the lower reverse bent section of the outer arm of each flat plate-shaped terminal of the first row, the width of the lower reverse bent section of the inner arm of each flat plate-shaped terminal of the first row, the width of the lower reverse bent section of the outer arm of each flat plate-shaped terminal of the second row, the width of the lower reverse bent section of the inner arm of each flat plate-shaped terminal of the second row, the width of the outward inclined arm section of the outer arm of each flat plate-shaped terminal of the first row, the width of the outward inclined arm section of the outer arm of each flat plate-shaped terminal of the second row and the width of the outward inclined arm section of the inner arm of each flat plate-shaped terminal of the second row are equal to each other.

In the embodiments of the present disclosure, in each flat plate-shaped terminal of the first row: the width of the upper reverse bent section of the inner arm is larger than the width of the upper reverse bent section of the outer arm, the width of the inward inclined arm section of the inner arm is equal to the width of the inward inclined arm section of the outer arm, the width of the outward inclined arm section of the inner arm is larger than or equal to the width of the outward inclined arm section of the outer arm, the width of the lower reverse bent section of the inner arm is equal to the width of the lower reverse bent section of the outer arm; the width of the upper reverse bent section of the inner arm is larger than the width of the inward inclined arm section of the inner arm, the width of the inward inclined arm section of the inner arm is larger than or equal to the width of the outward inclined arm section of the inner arm, the width of the outward inclined arm section of the inner arm is larger than or equal to the width of the lower reverse bent section of the inner arm; the width of the upper reverse bent section of the outer arm is equal to the width of the inward inclined arm section of the outer arm, the width of the inward inclined arm section of the outer arm is larger than the width of the outward inclined arm section of the outer arm, the width of the outward inclined arm section of the outer arm is equal to the width of the lower reverse bent section of the outer arm; the ratio of the width of the inner arm to the thickness of the inner arm and the ratio of the width of the outer arm to the thickness of the outer arm each range from 1.3 to 2.3. In each flat plate-shaped terminal of the second row: the width of the upper reverse bent section of the inner arm is larger than the width of the upper reverse bent section of the outer arm, the width of the inward inclined arm section of the inner arm is larger than the width of the inward inclined arm section of the outer arm, the width of the outward inclined arm section of the inner arm is equal to the width of the outward inclined arm section of the outer arm, the width of the lower reverse bent section of the inner arm equal to the width of the lower reverse bent section of the outer arm; the width of the upper reverse bent section of the inner arm is equal to the width of the inward inclined arm section of the inner arm, the width of the inward inclined arm section of the inner arm is larger than the width of the outward inclined arm section of the inner arm, the width of the outward inclined arm section of the inner arm is equal to the width of the lower reverse bent section of the inner arm; the width of the upper reverse bent section of the outer arm is equal to the width of the inward inclined arm section of the outer arm, the width of the inward inclined arm section of the outer arm is equal to the width of the outward inclined arm section of the outer arm, the width of the outward inclined arm section of the outer arm is equal to the width of the lower reverse bent section of the outer arm; the ratio of the width of the inner arm to the thickness of the inner arm and the ratio of the width of the outer arm to the thickness of the outer arm each range from 1.3 to 2.0.

In the embodiments of the present disclosure, each flat plate-shaped terminal further comprises a holding portion, the holding portion is configured to be interference fixed with the insulating housing.

In the embodiments of the present disclosure, the holding portion is integrally formed with the flat plate-shaped terminal.

In the embodiments of the present disclosure, the card edge connector further comprises a plurality of support blocks, each support block is positioned between the base portion and the holding portion, each terminal groove further comprises a support block receiving groove, the support block receiving grooves are communicated with each other, the support blocks are arranged side by side along the longitudinal direction in the support block receiving grooves which are communicated with each other.

In the embodiments of the present disclosure, the holding portion further comprises an interference protrusion, and wherein each support block receiving groove further comprises a shallow groove, the interference protrusion is interference fixed with the shallow groove.

In the embodiments of the present disclosure, each flat plate-shaped terminal further comprises a tail portion, the insulating housing further comprises a plurality of terminal tail portions fixing grooves, the terminal tail portion fixing groove is configured to position and receive the tail portion of the flat plate-shaped terminal.

In the embodiments of the present disclosure, an upper end of an inside of the first wall body has an inclined insertion guiding surface toward the card edge inserting groove.

In the embodiments of the present disclosure, each flat plate-shaped terminal is a two-arm configuration with a closed loop. The two-arm configuration has the inner arm and the outer arm arranged along the overall profile of each flat plate-shaped terminal. The inner arm and the outer arm of each flat plate-shaped terminal have different profiles, and the inner arm and the outer arm each can have different widths of the sections (that is, the width of the lower reverse bent section, the width of the outward inclined arm section, the width of the upper reverse bent section and the width of the inward inclined arm section are different). In addition, in some corresponding arm sections, the width of a section of the inner arm is larger than the width of a corresponding section of the outer arm, and in some sections, the outer arm is spaced apart from the inner arm by a relatively large spacing, such as the second spacing. Accordingly, the two-arm configuration with the closed loop of the flat plate-shaped terminal can control the deflection behavior of the flat plate-shaped terminal, prevent the excessive deflection of the flat plate-shaped terminal and in turn avoid permanent deformation of the flat plate-shaped terminal.

Relatively, in some existing terminals, since the widths of the two generally parallel planar beam sections of the terminal are the same, the stress applied by the board card to the two planar beam sections is relatively easy to exceed the stress that the two planar beam sections can bear when the board card is inserted in or pulled out, thereby causing the permanent deformation of the terminal, and such a permanent deformation is more easily occur at the bending locations of the two planar beam sections.

Technical features and advantages of the present disclosure are widely summarized as above, so as to better understand the following detailed description. Other technical feature making up technical solutions of the claims of the present disclosure and other advantages will be described below. A person skilled in the art of the present disclosure shall understand that the concept and specific embodiments disclosed below may be easily used to modify or design other configuration or manufacturing approach so as to realize the same object as the present disclosure. A person skilled in the art of the present disclosure shall also understand that, such an equivalent configuration or approach cannot be departed from the spirit and scope of the present disclosure defined by the appended claims.

BRIEF DESCRIPTION OF THE DRAWINGS

The various respects of the present disclosure may be best understood by the following detailed description taken in connection with the accompanying figures. It should be noted that, according to a standard implementing mode of the industries, features are not drawn as the scale. In practice, for the sake of clear explanation, various features may be arbitrarily enlarged or reduced in dimension.

DETAILED DESCRIPTION OF THE PREFERRED EMBODIMENTS

The following disclosed content provides various embodiments or exemplifications used to implement various features of the present disclosure. Specific examples of elements and arrangements are described as follows, so as to simplify the disclosed content of the present disclosure. Certainly, these are merely examples, and are not used to limit the present disclosure. For example, in the following description, that a first feature is formed on or above a second feature may comprise an embodiment that the first feature and the second are formed to directly contact with each other, may also comprise an embodiment that other feature is formed between the first feature and the second feature, therefore the first feature and the second feature do not directly contact with each other. Moreover, the present disclosure may allow a symbol and/or a character of an element to be repeated in different examples. The repetition is used for simplification and clearness, but is not used to dominate a relationship between various embodiments and/or discussed structures.

Moreover, the present disclosure may use spatial corresponding terminologies, such as "below", "lower than", "relative lower", "higher than", "relative high" and the like, so as to describe a relationship between an element or feature and another element or feature. Spatial corresponding terminologies are used to comprise various orientations of an apparatus in use or operation besides orientations illustrated in figures. Or the apparatus may be orientated (rotated by 90 degrees or at other orientation), and the corresponding spatial description in the present disclosure may be correspondingly explained. It should be understood that, when a feature is formed to another feature or above a substrate, other feature may be presented between them.

Figure 1:
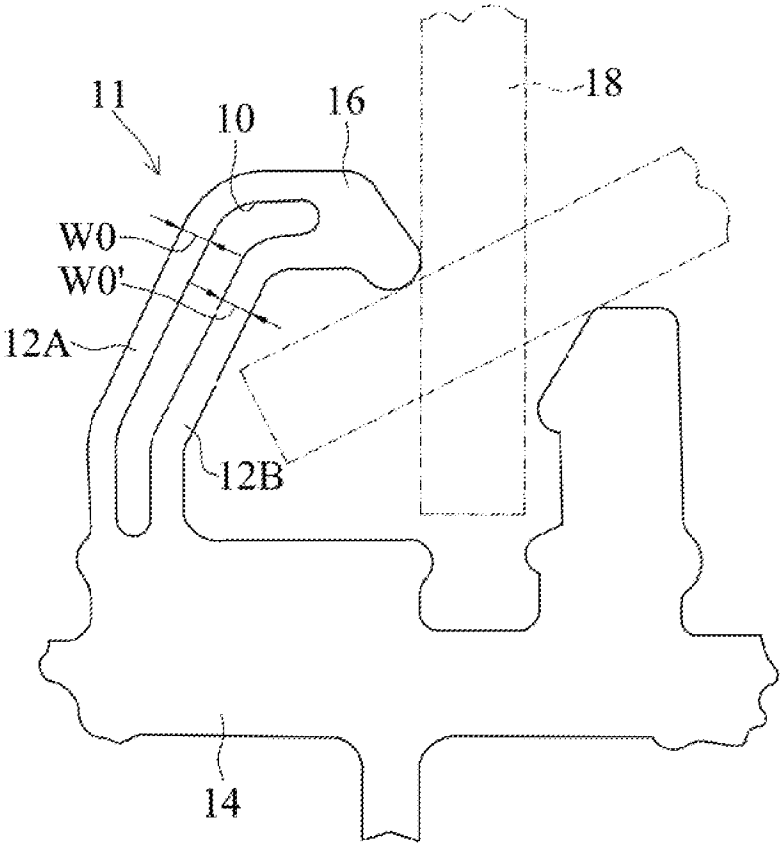
FIG. 1 is a structural schematic view of a terminal of an existing card edge connector.
Figure 2:
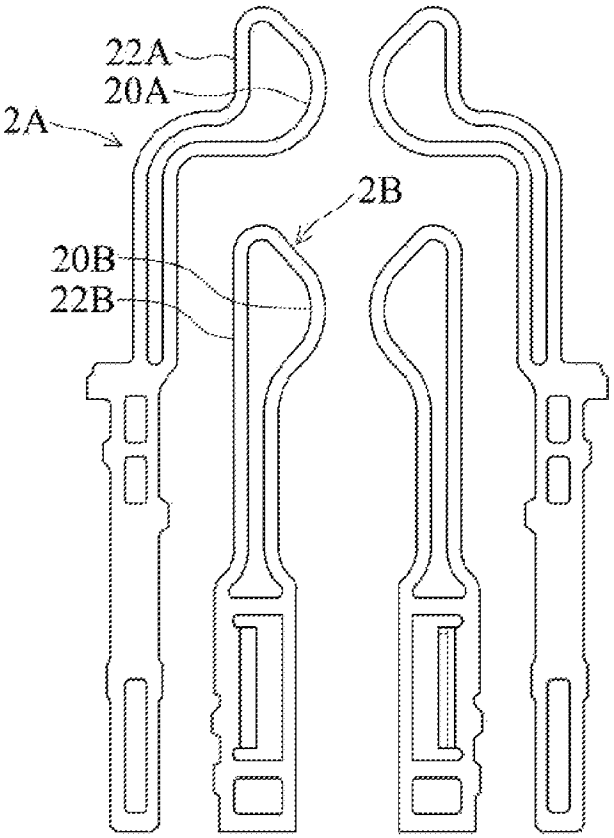
FIG. 2 is a structural schematic view of a terminal of an existing card edge connector.
Figure 3:
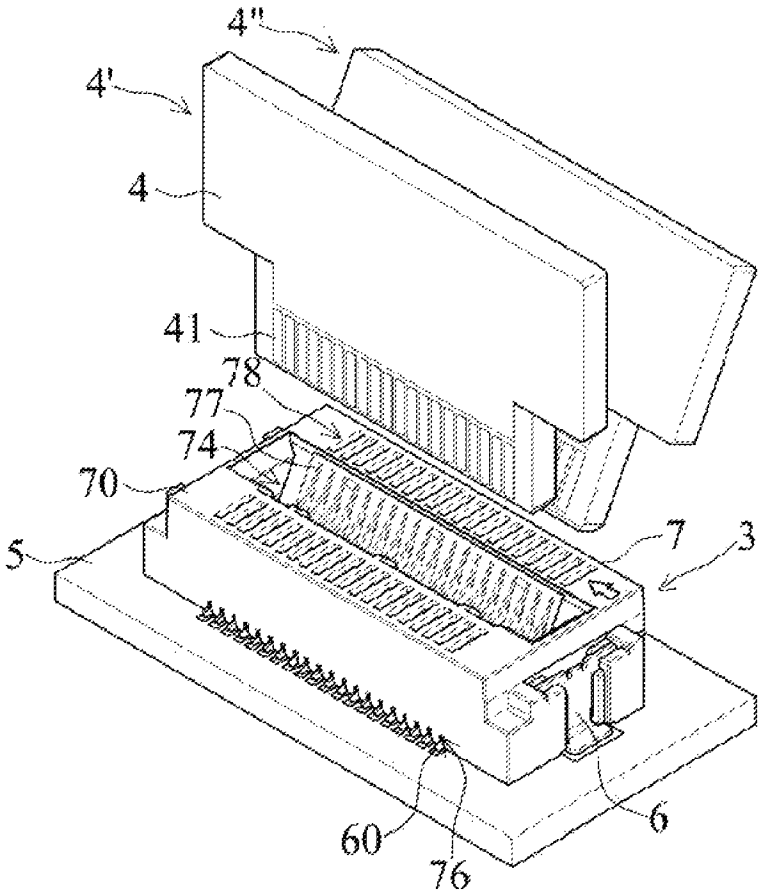
FIG. 3 is a top perspective schematic view of a card edge connector of an embodiment of the present disclosure.

FIG. 3 is a top perspective schematic view of a card edge connector 3 of embodiments of the present disclosure, the card edge connector 3 is mounted on a carrier board 5 and receives a card edge module 4. Referring to FIG. 3, although FIG. 3 shows an arrangement of the two card edge modules 4, it does not mean that the two card edge modules 4 are inserted into the card edge connector 3 at one time. Furthermore, the arrangement of the two card edge modules 4 is only for indicating that the card edge module 4 is inserted into the card edge connector 3 at a position between a position 4' and a position 4" and remains the orientation in an insertion direction. In some embodiments, the carrier board 5 comprises a printed circuit board (PCB).

Figure 4:
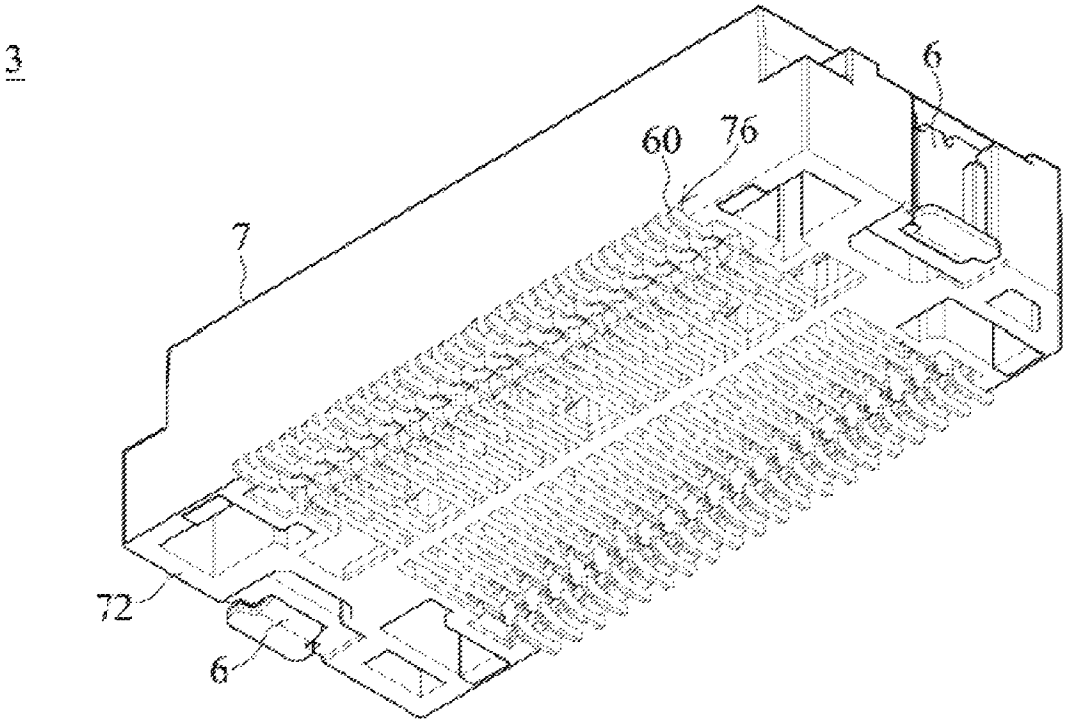
FIG. 4 is a bottom perspective schematic view of the card edge connector of FIG. 3.
Figure 5:
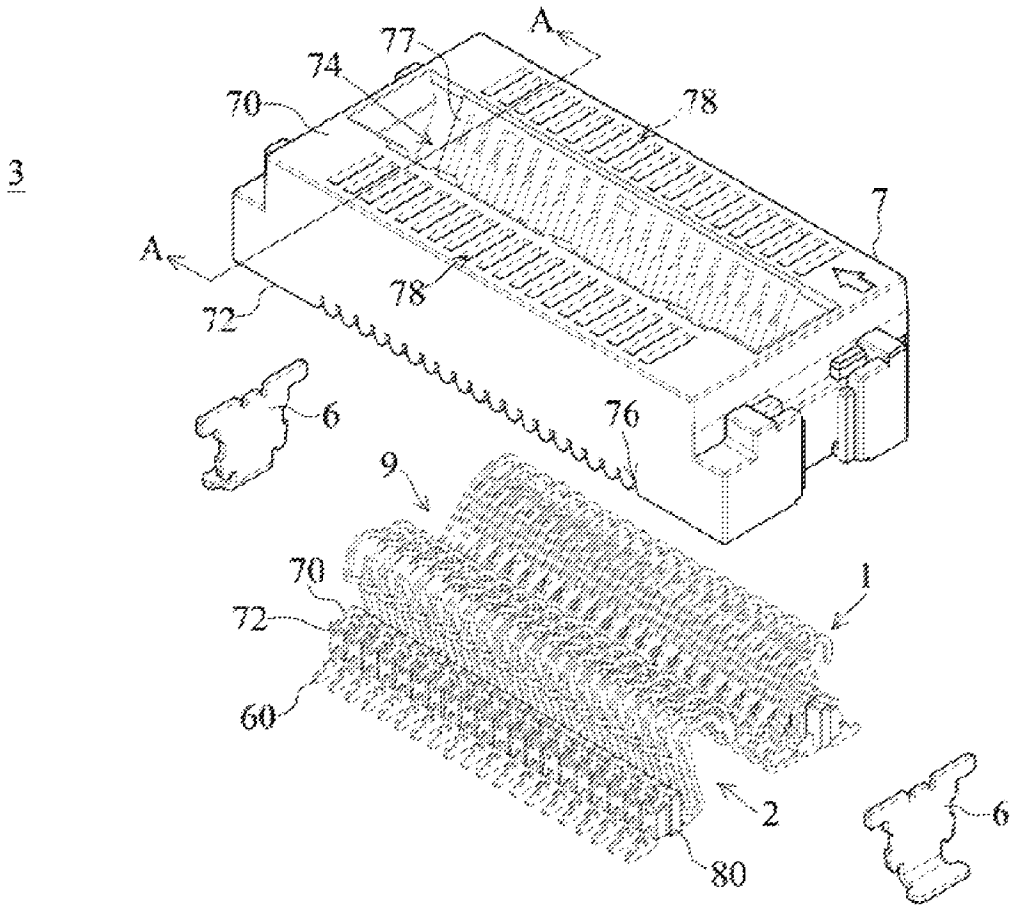
FIG. 5 is a top exploded schematic view of the card edge connector of FIG. 4.
Figure 6:
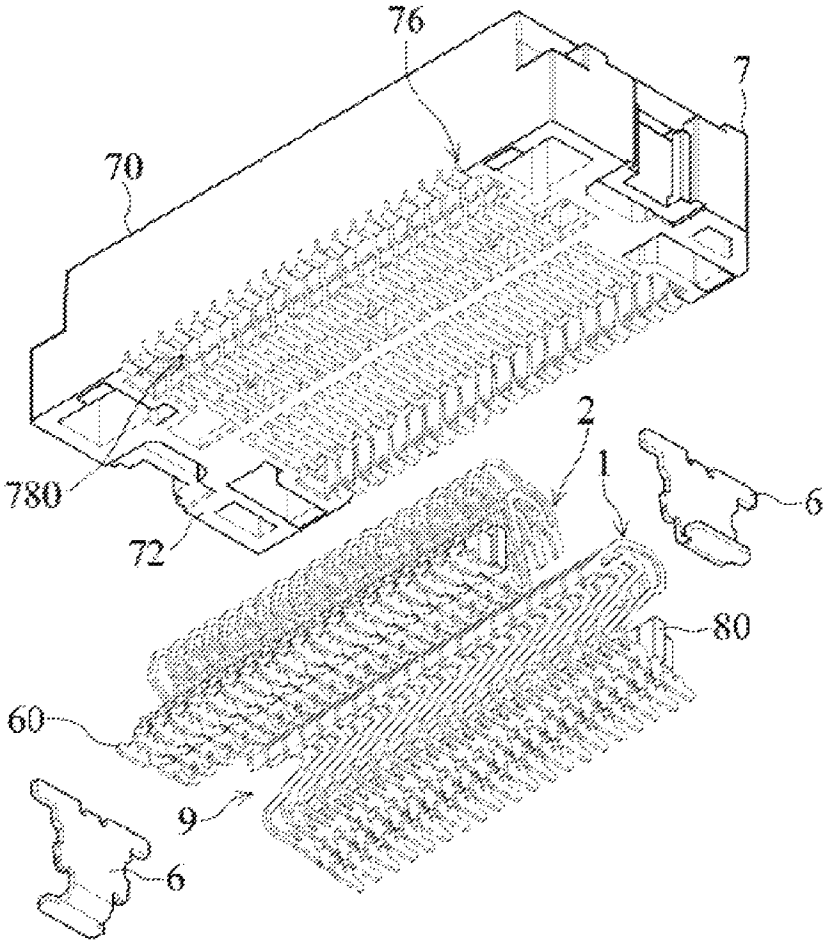
FIG. 6 is a bottom exploded perspective schematic view of the card edge connector of FIG. 4.

FIG. 4 is a bottom perspective schematic view of the card edge connector 3 of FIG. 3. FIG. 5 is a top exploded schematic view of the card edge connector 3 of FIG. 4. FIG. 6 is a bottom exploded perspective schematic view of the card edge connector 3 of FIG. 4. Referring to FIG. 4 to FIG. 6, the card edge connector 3 comprises an insulating housing 7, a plurality of flat plate-shaped terminals 9 and two auxiliary fixing members 6. Referring back to FIG. 3, the flat plate-shaped terminals 9 are mounted in the insulating housing 7 and are fixed on the carrier board 5, and the two auxiliary fixing members 6 assist the insulating housing 7 to be fixed on the carrier board 5.

The insulating housing 7 is formed as an elongated shape extending along a longitudinal direction and has a top surface 70 and a bottom surface 72 which define an up-down direction. The insulating housing 7 has a card edge inserting groove 74 on the top surface 70 along the longitudinal direction, the card edge inserting groove 74 is configured to receive the card edge module 4 (referring to FIG. 3).

Figure 7:
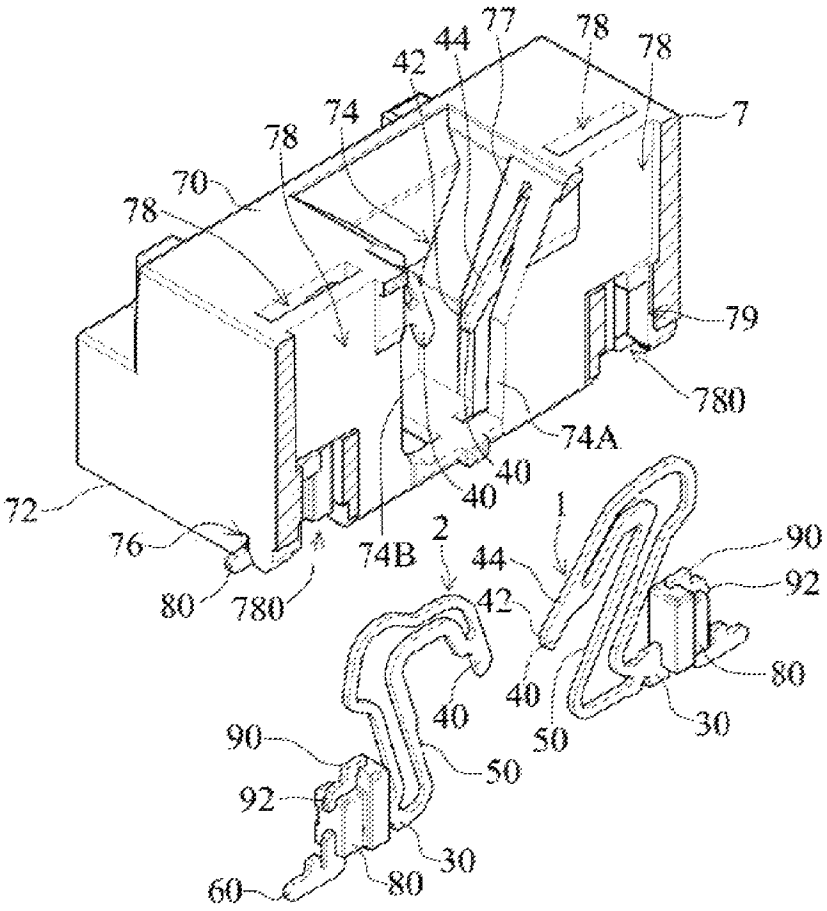
FIG. 7 is a cross sectional perspective schematic view taken along a line A-A of the card edge connector of FIG. 5.
Figure 8:
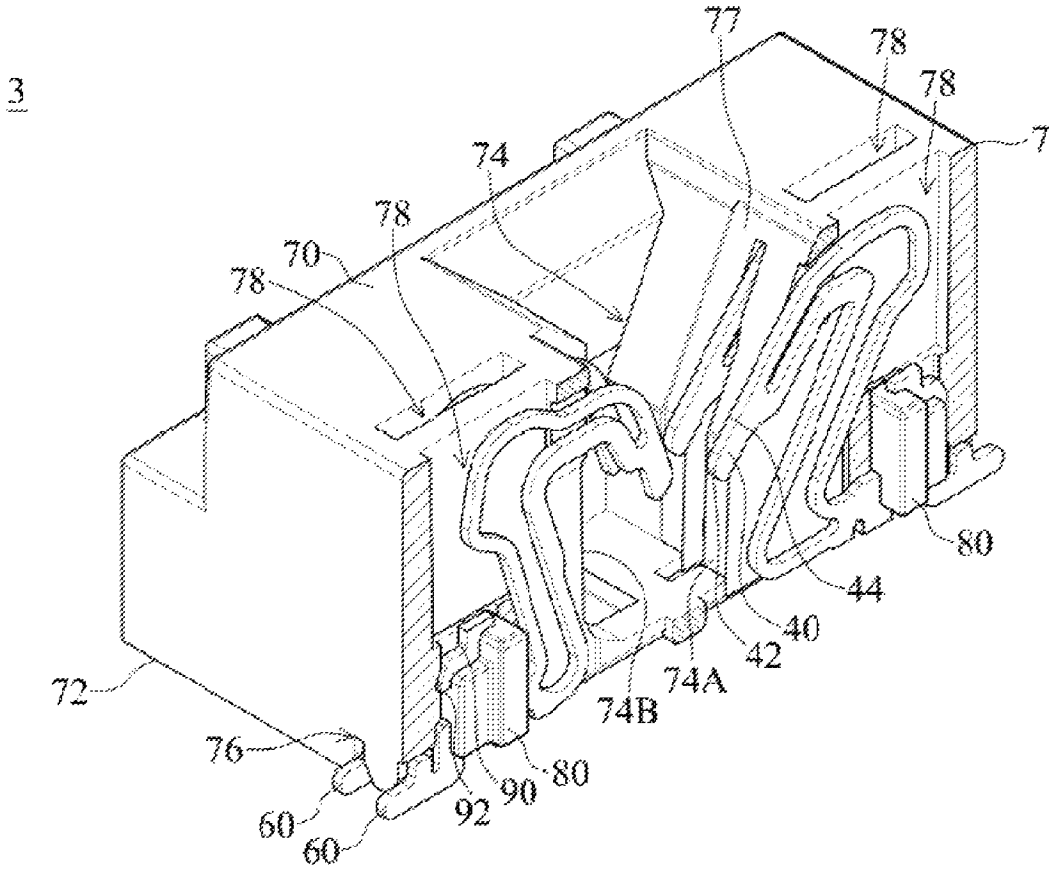
FIG. 8 is a cross sectional perspective schematic view after the flat plate-shaped terminals of the card edge connector of FIG. 7 are assembled.
Figure 9:
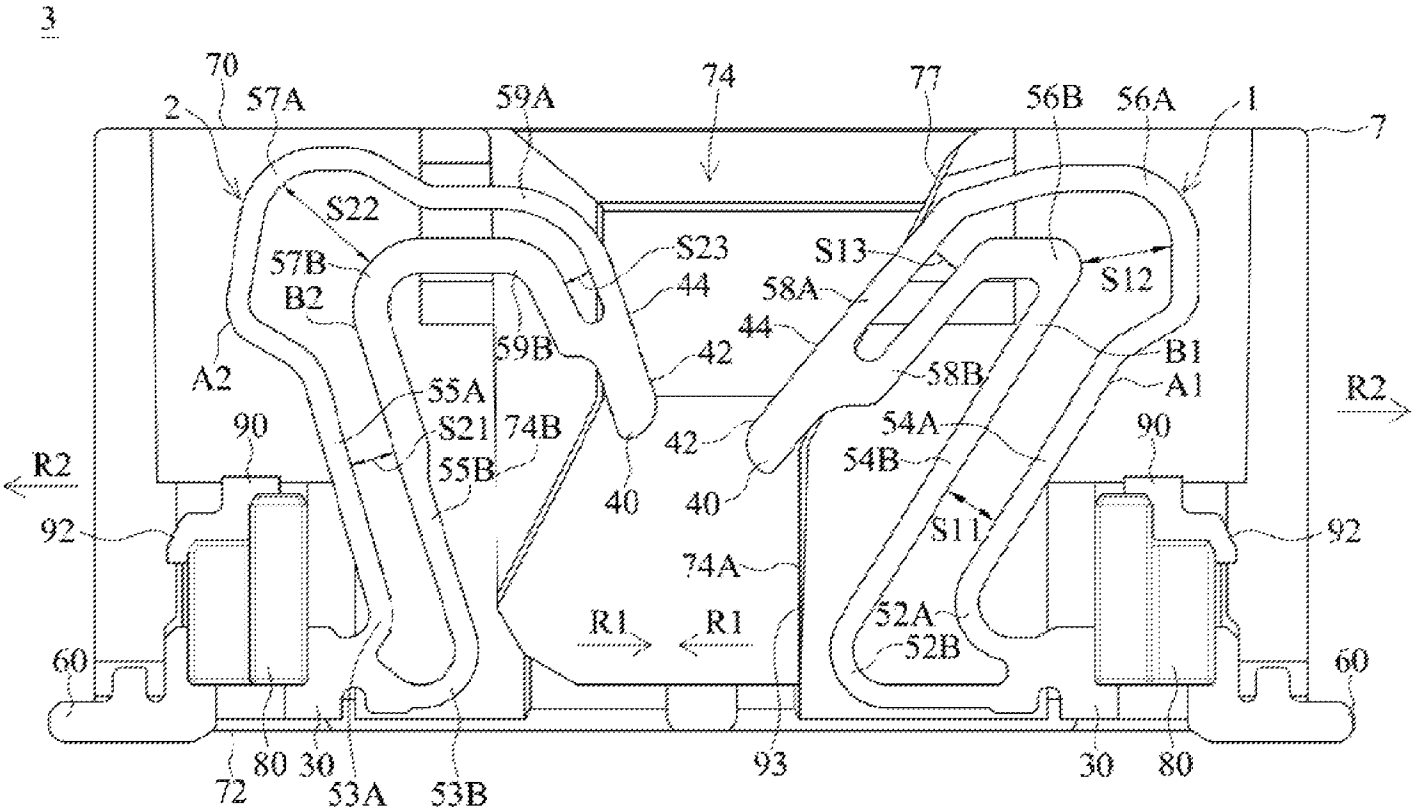
FIG. 9 is a planar cross sectional schematic view of the card edge connector of FIG. 8.

FIG. 7 is a cross sectional perspective schematic view taken along a line A-A of the card edge connector 3 of FIG. 5, in which only a perspective cross section of the insulating base 7 and a situation where one pair of the flat plate-shaped terminals 9 are separated from the terminal grooves 78 of the insulating base 7 are shown. FIG. 8 is a cross sectional perspective schematic view after the flat plate-shaped terminals 9 of the card edge connector 3 of FIG. 7 are assembled. FIG. 9 is a planar cross sectional schematic view of the card edge connector 3 of FIG. 8.

Referring to FIG. 7 to FIG. 9, the card edge inserting groove 74 separates the insulating housing 7 into a first wall body 74A and a second wall body 74B. A direction that the first wall body 74A and the second wall body 74B face each other defines a transversal direction. The insulating housing 7 has a plurality of terminal grooves 78, each of the first wall body 74A and the second wall body 74B has the terminal grooves 78 which are arranged side by side in the longitudinal direction and each are provided in the transversal direction. The plurality of flat plate-shaped terminals 9 comprise a first row 1 of flat plate-shaped terminals and a second row 2 of flat plate-shaped terminals. Each flat plate-shaped terminal of the first row 1 is mounted in each terminal groove 78 of the first wall body 74A, and each flat plate-shaped terminal of the second row 2 is mounted in each terminal groove 78 of the second wall body 74B. An extending direction of a plate surface of each flat plate-shaped terminal 9 is parallel to the transversal direction. In an embodiment, each flat plate-shaped terminal of the first row 1 is different each flat plate-shaped terminal of the second row 2 in profile. In another embodiment, each flat plate-shaped terminal of the first row 1 can be the same as each flat plate-shaped terminal of the second row 2 in profile. In addition, a direction that each of the first wall body 74A and the second wall body 74B faces the card edge inserting groove 74 is an inner direction R1, and a direction that each of the first wall body 74A and the second wall body 74B is away from the card edge inserting groove 74 is an outer direction R2. Also, an upper end of an inside 93 of the first wall body 74A of the insulating housing 7 has an inclined insertion guiding surface 77 toward the card edge inserting groove 74. The inclined insertion guiding surface 77 is configured to guide the card edge module 4 when the card edge module 4 is inclined and inserted into the card edge inserting groove 74.

Figure 10:
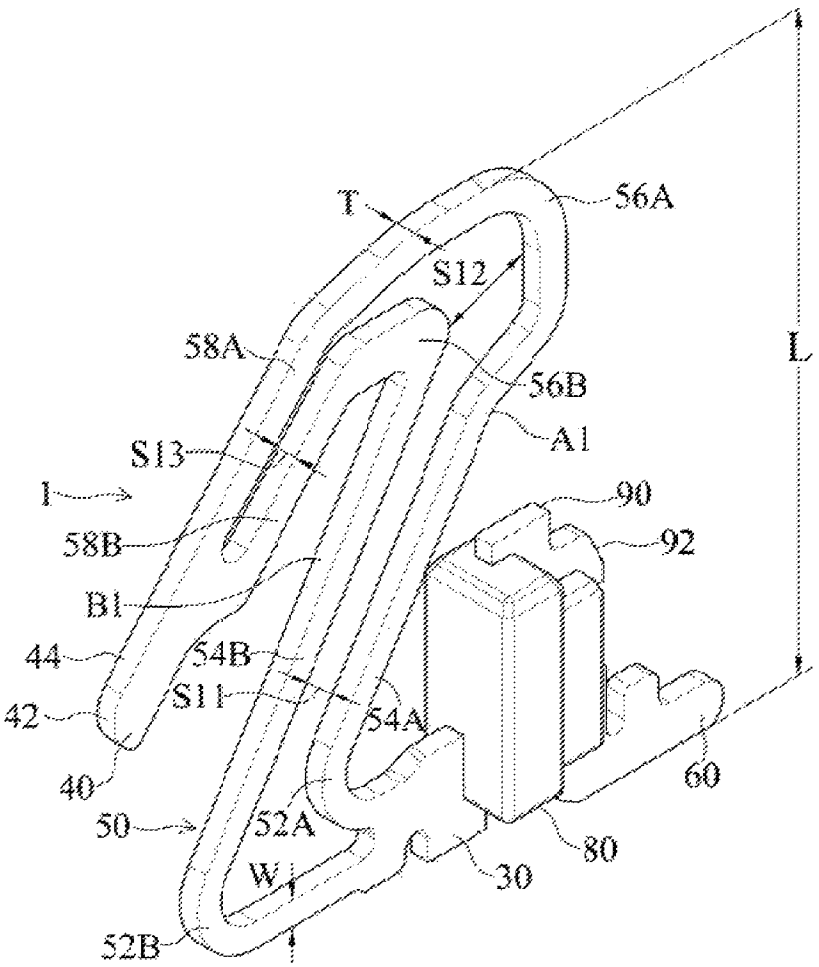
FIG. 10 is a top perspective schematic view of the flat plate-shaped terminal of the card edge connector of FIG. 4.

Hereinafter, referring to FIG. 9 and FIG. 10, common structural features of the flat plate-shaped terminals 9 will be first described, and hereinafter the flat plate-shaped terminal of the first row 1 is taken as an example, and these structural features are also applicable to the flat plate-shaped terminal of the second row 2. FIG. 10 is a top perspective schematic view of the flat plate-shaped terminal 9 of the card edge connector 3 of FIG. 4.

Each flat plate-shaped terminal 9 comprises a base portion 30, a contact portion 40, an elastic arm portion 50, a tail portion 60. The base portion 30 is positioned at a lower side of the flat plate-shaped terminal 9. The contact portion 40 is positioned above the base portion 30 and extends into the card edge inserting groove 74 toward the inner direction R1, as shown in FIG. 7 to FIG. 9. The elastic arm portion 50 is positioned between the base portion 30 and the contact portion 40. The contact portion 40 has a contact edge 42 and a guide edge 44. The guide edge 44 is positioned above the contact edge 42, the guide edge 44 is configured to guide the card edge module 4 when the card edge module 4 is inserted into the card edge inserting groove 74. In some embodiments, the tail portion 60 comprises a surface-soldering tail portion, and the flat plate-shaped terminal 9 is fixed on the carrier board 5 by soldering the surface-soldering tail portion on the carrier board 5.

The elastic arm portion 50 sequentially comprises a lower reverse bent section, an outward inclined arm section, an upper reverse bent section and an inward inclined arm section. The lower reverse bent section connects one end of the base portion 30 in the inner direction R1, extends from the base portion 30 toward the inner direction R1, bends reversely and extends toward the outer direction R2 and an inclined upward direction. The outward inclined arm section extends toward the outer direction R2 and the inclined upward direction. The upper reverse bent section bends reversely and extends toward the inner direction R1 and an inclined downward direction. The inward inclined arm section extends toward the inner direction R1 and the inclined downward direction.

Furthermore, the elastic arm portion 50 is a two-arm configuration with a closed loop. The two-arm configuration has an inner arm and an outer arm, the inner arm and the outer arm are arranged along an overall profile of each flat plate-shaped terminal 9 and have different profiles. The inner arm and the outer arm each have the corresponding lower reverse bent section, the corresponding outward inclined arm section, the corresponding upper reverse bent section and the corresponding inward inclined arm section, which will be described in detail below.

Hereinafter, a thickness T, a width W, a height L of the flat plate-shaped terminal 9 will be discussed. The thickness T refers to a plate thickness of the flat plate-shaped terminal 9, that is a thickness of the flat plate-shaped terminal 9 in the longitudinal direction, the width W refers to a width of each section of the flat plate-shaped terminal 9 along a plate surface direction, the height L refers to a distance between an upper end of the upper reverse bent section 56 of the flat plate-shaped terminal 9 and a lower end of the base portion 30 in an up-down direction, that is a total height of the flat plate-shaped terminal 9. In the embodiment, the flat plate-shaped terminal 9 is formed by blanking and stamping a plate, thus the base portion 30, the lower reverse bent section, the outward inclined arm section, the upper reverse bent section, the inward inclined arm section and the contact portion 40 of the flat plate-shaped terminal 9 all have the same thicknesses T and are positioned on the same plate surface.

Referring to FIG. 9 and FIG. 10, the common structural features which the sections of the arm of each flat plate-shaped terminal of the first row 1 and the sections of the arm of each flat plate-shaped terminal of the second row 2 in the width W have will be described below. As above, hereinafter each flat plate-shaped terminal of the first row 1 is taken as an example, for the sake of convenient discussion, the internal structures of the flat plate-shaped terminal of the first row 1 are marked as follows: the outer arm is marked as A1 and the inner arm is marked as B1; the lower reverse bent section of the outer arm A1 is marked as 52A, the outward inclined arm section is marked as 54A, the upper reverse bent section is marked as 56A, the inward inclined arm section is marked as 58A; and the lower reverse bent section of the inner arm B1 is marked as 52B, the outward inclined arm section is marked as 54B, the upper reverse bent section is marked as 56B, the inward inclined arm section is marked as 58B. The common structural features can be represented as:

(1) The width W of the upper reverse bent section 56B of the inner arm B1 is the largest among the sections of the inner arm B1 and the sections of the outer arm A1; and the width W of the upper reverse bent section 56B of the inner arm B1 is larger than the width W of the upper reverse bent section 56A of the outer arm A1.

(2) The width W of the lower reverse bent section 52B of the inner arm B1 is the smallest among the sections of the inner arm B1; and, the width W of the lower reverse bent section 52A of the outer arm A1 is the smallest among the sections of the outer arm A1.

(3) The width W of the lower reverse bent section 52B of the inner arm B1 is larger than or equal to the width W of the lower reverse bent section 52A of the outer arm A1; in an embodiment, the width W of the lower reverse bent section 52B of the inner arm B1 is equal to the width W of the lower reverse bent section 52A of the outer arm A1.

(4) The width W of the outward inclined arm section 54B of the inner arm B1 is larger than or equal to the width W of the outward inclined arm section 54A of the outer arm A1, the width W of the inward inclined arm section 58B of the inner arm B1 is larger than or equal to the width W of the inward inclined arm section 58A of the outer arm A1.

(5) The outward inclined arm section 54A of the outer arm A1 is spaced apart from the outward inclined arm section 54B of the inner arm B1 by a first spacing S11, the upper reverse bent section 56A of the outer arm A1 is spaced apart from the upper reverse bent section 56B of the inner arm B1 by a second spacing S12, the inward inclined wall section 58A of the outer arm A1 is spaced apart from the inward inclined wall section 58B of the inner arm B1 by a third spacing S13. And the second spacing S12 is larger than the first spacing S11 and the third spacing S13. In an embodiment, the second spacing S12 is larger than the first spacing S11, and the first spacing S11 is larger than the third spacing S13; accordingly, it is possible to prevent the outer arm A1 and the inner arm B1 from interfering with each other when the flat plate-shaped terminal 9 is elastically deformed.

(6) The ratio of the width W of the inner arm B1 to a thickness T of the inner arm B1 ranges from 1.3 to 2.3, and a ratio of the width W of the outer arm A1 to a thickness T of the outer arm A1 ranges from 1.3 to 2.3.

In conclusion, in the present disclosure, the flat plate-shaped terminal 9 is a two-arm configuration with a closed loop, the two-arm configuration has the inner arm B1 and the outer arm A1 which are arranged along the overall profile of the flat plate-shaped terminal 9. The inner arm B1 and the outer arm A1 of the flat plate-shaped terminal 9 have different profiles, and the inner arm B1 and the outer arm A1 each can have the different widths of the sections. In addition, in some corresponding sections, the width W of a section of the inner arm B1 is larger than the width W of the corresponding section of the outer arm A1, and in some sections, the outer arm A1 is spaced apart from the inner arm B1 by a relatively large spacing, such as the second spacing S12. Accordingly, the behavior of the deflection of the flat plate-shaped terminal 9 can be controlled to prevent excessive deflection of the flat plate-shaped terminal 9 and in turn to avoid permanent deformation of the flat plate-shaped terminal 9.

In an embodiment, each flat plate-shaped terminal of the first row 1 and each flat plate-shaped terminal of the second row 2 have different profiles. For the sake of convenient discussion, referring back to FIG. 10 and FIG. 11, the internal structures of the flat plate-shaped terminal of the second row 2 is marked as follows: the outer arm is marked as A2 and the inner arm is marked as B2; the lower reverse bent section of the outer arm A2 is marked as 53A, the outward inclined arm section is marked as 55A, the upper reverse bent section is marked as 57A, the inward inclined arm section is marked as 59A; and, the lower reverse bent section of the inner arm B2 is marked as 53B, the outward inclined arm section is marked as 55B, the upper reverse bent section is marked as 57B, the inward inclined arm section is marked as 59B. Referring to FIG. 9, a relationship between the widths W of sections of the arms of each flat plate-shaped terminal of the first row 1 and widths W of sections of the arms of each flat plate-shaped terminal of the second row 2 can be represented as follows:

(1) The width W of the upper reverse bent section 56B of the inner arm B1 of each flat plate-shaped terminal of the first row 1 is larger than the width W of the upper reverse bent section 57B of the inner arm B2 of each flat plate-shaped terminal of the second row 2.

(2) The width W of the inward inclined arm section 59B of the inner arm B2 of each flat plate-shaped terminal of the second row 2 is larger than the width W of the inward inclined arm section 58B of the inner arm B1 of each flat plate-shaped terminal of the first row 1.

(3) The width W of the inward inclined arm section 58A of the outer arm A1 of each flat plate-shaped terminal of the first row 1 is equal to the width W of the upper reverse bent section 56A of the outer arm A1 of each flat plate-shaped terminal of the first row 1, the width W of the inward inclined arm section 59A of the outer arm A2 of each flat plate-shaped terminal of the second row 2 is equal to the width W of the upper reverse bent section 57A of the outer arm A2 of each flat plate-shaped terminal of the second row 2, and the width W of the inward inclined arm section 58A of the outer arm A1 and the width W of the upper reverse bent section 56A of the outer arm A1 of each flat plate-shaped terminal of the first row 1 is larger than the width W of the inward inclined arm section 59A of the outer arm A2 and the upper reverse bent section 57A of the outer arm A2 of each flat plate-shaped terminal of the second row 2.

(4) The width W of the outward inclined arm section 54B of the inner arm B1 of each flat plate-shaped terminal of the first row 1 is larger than or equal to the width W of the outward inclined arm section 55B of the inner arm B2 of each flat plate-shaped terminal of the second row 2.

(5) The width W of the lower reverse bent section 52A of the outer arm A1 of each flat plate-shaped terminal of the first row 1, the width W of the lower reverse bent section 52B of the inner arm B1 of each flat plate-shaped terminal of the first row 1, the width W of the lower reverse bent section 53A of the outer arm A2 of each flat plate-shaped terminal of the second row 2, the width W of the lower reverse bent section 53B of the inner arm B2 of each flat plate-shaped terminal of the second row 2, the width W of the outward inclined arm section 54A of the outer arm A1 of each flat plate-shaped terminal of the first row 1, the width W of the outward inclined arm section 55A of the outer arm A2 of each flat plate-shaped terminal of the second row 2 and the width W of the outward inclined arm section 55B of the inner arm B2 of each flat plate-shaped terminal of the second row 2 are equal to each other.

(6) A height of the contact portion 40 of each flat plate-shaped terminal of the first row 1 is lower than a height of the contact portion 40 of each flat plate-shaped terminal of the second row 2.

(7) A sharp angle between the guide edge 44 of each flat plate-shaped terminal of the first row 1 and the up-down direction is larger than a sharp angle between the guide edge 44 of each flat plate-shaped terminal of the second row 2 and the up-down direction, in other words, the guide edge 44 of each flat plate-shaped terminal of the second row 2 is steeper than the guide edge 44 of each flat plate-shaped terminal of the second row 2 toward the inward and the downward.

A relationship of the profile of each flat plate-shaped terminal of the first row 1 and a relationship the profile of each flat plate-shaped terminal of the second row 2 will be respectively described below.

In each flat plate-shaped terminal of the first row 1:

(1) A ratio of the width W of the inner arm B1 to the thickness T of the inner arm B1 and a ratio of the width W of the outer arm A1 to the thickness T of the outer arm A1 each range from 1.3 to 2.3. In some embodiments, one endpoint value of the range of the ratio is not limited to 1.3 and can be any value between 1.3 and 2.3. In some embodiments, the other endpoint value of the range of the ratio is not limited to 2.3 and can be any value between 1.3 and 2.3.

(2) The width W of the upper reverse bent section 56B of the inner arm B1 is larger than the width W of the upper reverse bent section 56A of the outer arm A1, the width W of the inward inclined arm section 58B of the inner arm B1 is equal to the width W of the inward inclined arm section 58A of the outer arm A1, the width W of the outward inclined arm section 54B of the inner arm B1 is larger than or equal to the width W of the outward inclined arm section 54A of the outer arm A1, and the width W of the lower reverse bent section 52B of the inner arm B1 is equal to the width W of the lower reverse bent section 52A of the outer arm A1.

(3) The width W of the upper reverse bent section 56B of the inner arm B1 is larger than the width W of the inward inclined arm section 58B of the inner arm B1, the width W of the inward inclined arm section 58B of the inner arm B1 is larger than or equal to the width W of the outward inclined arm section 54B of the inner arm B1, and the width W of the outward inclined arm section 54B of the inner arm B1 is larger than or equal to the width W of the lower reverse bent section 52B of the inner arm B1.

(4) The width W of the upper reverse bent section 56A of the outer arm A1 is equal to the width W of the inward inclined arm section 58A of the outer arm A1, the width W of the inward inclined arm section 58A of the outer arm A1 is larger than the width W of the outward inclined arm section 54A of the outer arm A1, the width W of the outward inclined arm section 54A of the outer arm A1 is equal to the width W of the lower reverse bent section 52A of the outer arm A1.

(5) The outward inclined arm section 54A of the outer arm A1 is spaced apart from the outward inclined arm section 54B of the inner arm B1 by a first spacing S11, the upper reverse bent section 56A of the outer arm A1 is spaced apart from the upper reverse bent section 56B of the inner arm B1 by a second spacing S12, the inward inclined wall section 58A of the outer arm A1 is spaced apart from the inward inclined wall section 58B of the inner arm B1 by a third spacing S13. The second spacing S12 is larger than first spacing S11, and the first spacing S11 is larger than the third spacing S13.

In each flat plate-shaped terminal of the second row 2:

(1) A ratio of the width W of the inner arm B2 to the thickness T of the inner arm B2 and a ratio of the width W of the outer arm A2 to the thickness T of the outer arm A2 each range from 1.3 to 2.0. In some embodiments, one endpoint value of the range of the ratio is not limited to 1.3, which can be any value between 1.3 and 2.0. In some embodiments, the other endpoint value of the range of the ratio is not limited to 2.0, which can be any value between 1.3 and 2.0.

(2) The width W of the upper reverse bent section 57B of the inner arm B2 is larger than the width W of the upper reverse bent section 57A of the outer arm A2, the width W of the inward inclined arm section 59B of the inner arm B2 is larger than the width W of the inward inclined arm section 59A of the outer arm A2, the width W of the outward inclined arm section 55B of the inner arm B2 is equal to the width W of the outward inclined arm section 55A of the outer arm A2, the width W of the lower reverse bent section 53B of the inner arm B2 is equal to the width W of the lower reverse bent section 53A of the outer arm A2.

(3) The width W of the upper reverse bent section 57B of the inner arm B2 is equal to the width W of the inward inclined arm section 59B of the inner arm B2, the width W of the inward inclined arm section 59B of the inner arm B2 is larger than the width W of the outward inclined arm section 55B of the inner arm B2, the width W of the outward inclined arm section 55B of the inner arm B2 is equal to the width W of the lower reverse bent section 53B of the inner arm B2.

(4) The width W of the upper reverse bent section 57A of the outer arm A2 is equal to the width W of the inward inclined arm section 59A of the outer arm A2, the width W of the inward inclined arm section 59A of the outer arm A2 is equal to the width W of the outward inclined arm section 55A of the outer arm A2, the width W of the outward inclined arm section 55A of the outer arm A2 is equal to the width W of the lower reverse bent section 53A of the outer arm A2.

(5) The outward inclined arm section 55A of the outer arm A2 is spaced apart from the outward inclined arm section 55B of the inner arm B2 by a first spacing S21, the upper reverse bent section 57A of the outer arm A2 is spaced apart from the upper reverse bent section 57B of the inner arm B2 by a second spacing S22, the inward inclined wall section 59A of the outer arm A2 is spaced apart from the inward inclined wall section 59B of the inner arm B2 by a third spacing S23. The second spacing S22 is larger than the first spacing S21, and the first spacing S21 is larger than the third spacing S23.

Figure 11:
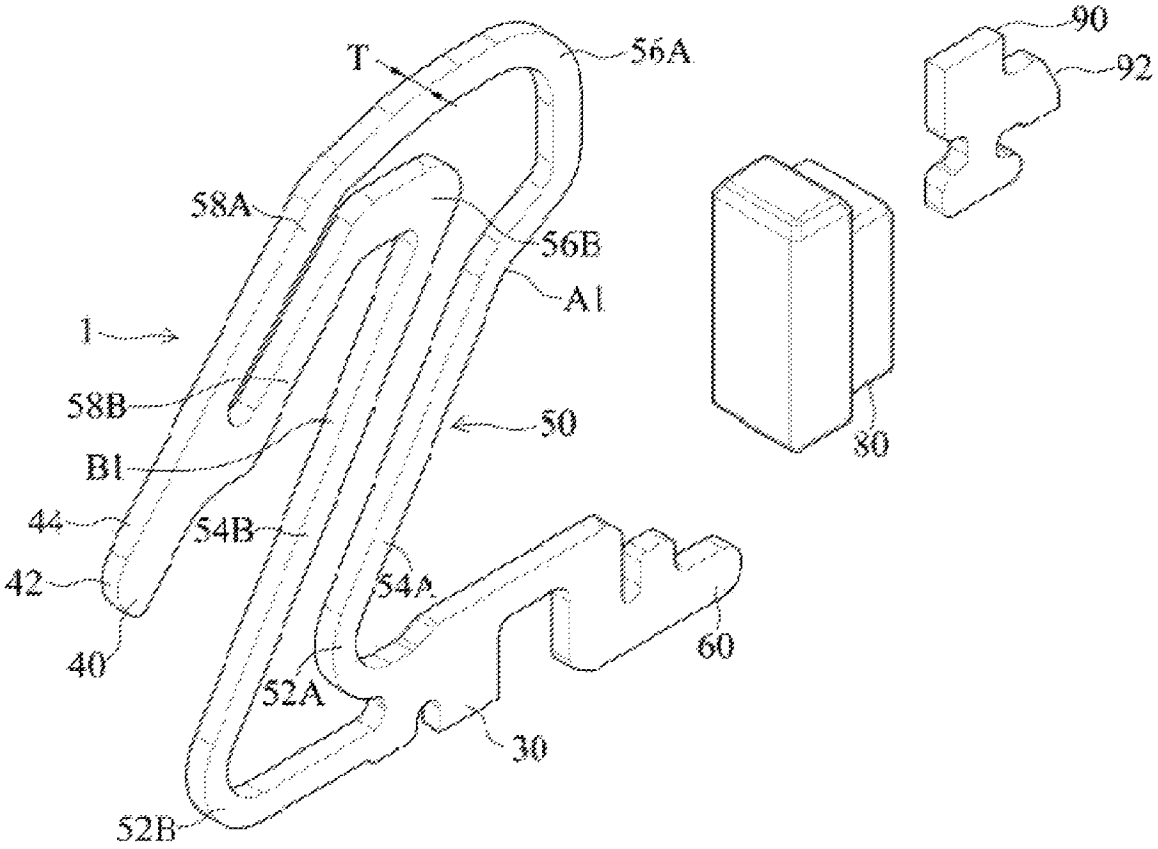
FIG. 11 is a top exploded perspective schematic view of the flat plate-shaped terminal of the card edge connector of FIG. 4.

Referring to FIG. 11, each flat plate-shaped terminal 9 of the card edge connector 3 further comprises a holding portion 90 extending upwardly from the base portion 30 and is configured to be interference fixed with the insulating housing 7. The holding portion 90 further comprises an interference protrusion 92. Each flat plate-shaped terminal 9 further comprises a support block 80, each support block 80 is positioned between the base portion 30 and the holding portion 90 of each flat plate-shaped terminal 9. The support block 80 holds the holding portion 90 on the base portion 30 by injection molding. Referring to FIG. 6 and FIG. 7, each terminal groove 78 further comprises a support block receiving groove 780, each support block receiving groove 780 has a shallow groove 79 therein, the support block receiving grooves 780 are arranged side by side along the longitudinal direction and are communicated with each other. Each flat plate-shaped terminal 9 is inserted into each terminal groove 78 from down to up, the support block 80 of each flat plate-shaped terminal 9 is received in each support block receiving groove 780, the interference protrusion 92 on the holding portion 90 of each flat plate-shaped terminal 9 is interference fixed with each shallow groove 79. The support blocks 80 are arranged side by side along the longitudinal direction in the support block receiving grooves 780 which are communicated with each other. The material of each support block 80 is an electrically insulating material, so even if the support block receiving grooves 780 are communicated with each other to make the support blocks 80 to contact with each other, it does not have an adverse affect on the card edge connector 3. However, in the embodiment, the holding portion 90 is separated from the base portion 30 of the flat terminal 9, the present disclosure is not limited to this, in some embodiments, the card edge connector 3 does not comprise the support blocks 80 and the support block receiving grooves 780, the holding portion 90 is integrally formed with the base portion 30 of the flat plate-shaped terminal 9.

In addition, referring to FIG. 3 and FIG. 7, the insulating housing 7 further comprises a plurality of terminal tail portion fixing grooves 76. The terminal tail portion fixing groove 76 is configured to position and receive the tail portion 60 of the flat plate-shaped terminal 9. Also, referring to FIG. 3, the card edge module 4 comprises a plurality of conductive pads 41. After the card edge module 4 is inserted into the card edge inserting groove 74, the conductive pads 41 are electrically connected with the contact portions 40 of the flat plate-shaped terminals 9.

Features of some embodiments are summarized in above content, so that a person skilled in the art may better understand various aspects of the disclosed content of the present disclosure. A person skilled in the art of the present disclosure shall understand that the disclosed content of the present disclosure may be easily used to configure and design or modify other manufacturing approach or structure and in turn to realize the same object and/or attain the same advantage as the embodiments of the present disclosure. A person skilled in the art of the present disclosure shall also understand that, such an equivalent approach or structure cannot be departed from the spirit and scope of the disclosed content of the present disclosure, and a person skilled in the art may make various changes, substitutions and replacements, which are not departed from the spirit and scope of the disclosed content of the present disclosure.

The invention claimed is:

1. A card edge connector, comprising:

an insulating housing, the insulating housing being formed as an elongated shape extending along a longitudinal direction, the insulating housing having a top surface and a bottom surface which define an up-down direction, the insulating housing having a card edge inserting groove on the top surface along the longitudinal direction, the card edge inserting groove separating the insulating housing into a first wall body and a second wall body, a direction that the first wall body and the second wall body face each other defining a transversal direction, a direction that each of the first wall body and the second wall body faces the card edge inserting groove being an inner direction, and a direction that each of the first wall body and the second wall body is away from the card edge inserting groove being an outer direction, at least one of the first wall body and the second wall body having a plurality of terminal grooves which are arranged side by side in the longitudinal direction and each are provided in the transversal direction; and a plurality of flat plate-shaped terminals, each flat plate-shaped terminal being mounted in the corresponding terminal groove, an extending direction of a plate surface of each flat plate-shaped terminal being parallel to the transversal direction, each flat plate-shaped terminal comprising:

a base portion positioned at a lower side of the flat plate-shaped terminal;

a contact portion positioned above the base portion and extending into the card edge inserting groove; and an elastic arm portion positioned between the base portion the contact portion, the elastic arm portion sequentially comprising:

a lower reverse bent section connecting the base portion, extending from the base portion toward the inner direction, reversely bending, and extending toward the outer direction and an inclined upward direction;

an outward inclined arm section extending toward the outer direction and the inclined upward direction;

an upper reverse bent section reversely bending and extending toward the inner direction and an inclined downward direction; and an inward inclined arm section extending toward the inner direction and the inclined downward direction, wherein the elastic arm portion is a two-arm configuration with a closed loop, the two-arm configuration has an inner arm and an outer arm, the inner arm and the outer arm are arranged along as overall profile of each flat plate-shaped terminal and have different profiles, the inner arm and the outer arm each have the corresponding lower reverse bent section, the corresponding outward inclined arm section, the corresponding upper reverse bent section and the corresponding inward inclined arm section which respectively correspond to the sections of the elastic arm portion.

2. The card edge connector of claim 1, wherein the outward inclined arm section of the outer arm is spaced apart from the outward inclined arm section of the inner arm by a first spacing, the upper reverse bent section of the outer arm is spaced apart from the upper reverse bent section of the inner arm by a second spacing, the inward inclined wall section of the outer arm is spaced apart from the inward inclined wall section of the inner arm by a third spacing, and the second spacing is larger than the first spacing and the third spacing.

3. The card edge connector of claim 2, wherein a thickness refers to a plate thickness of each flat plate-shaped terminal, and a width refers to a width of each section of each flat plate-shaped terminal along a plate surface direction, wherein the width of the upper reverse bent section of the inner arm is the largest among the sections of the inner arm and the sections of the outer arm, wherein the width of the lower reverse bent section of the inner arm is the smallest among the sections of the inner arm, and the width of the lower reverse bent section of the outer arm is the smallest among the sections of the outer arm, wherein the width of the lower reverse bent section of the inner arm is larger than or equal to the width of the lower reverse bent section of the outer arm, the width of the outward inclined arm section of the inner arm is larger than or equal to the width of the outward inclined arm section of the outer arm, the width of the inward inclined arm section of the inner arm is larger than or equal to the width of the inward inclined arm section of the outer arm.

4. The card edge connector of claim 3, wherein the second spacing is larger than the first spacing, and the first spacing is larger than the third spacing.

5. The card edge connector of claim 4, wherein the width of the lower reverse bent section of the inner arm is equal to the width of the lower reverse bent section of the outer arm.

6. The card edge connector of claim 5, wherein a ratio of the width of the inner arm to the thickness of the inner arm range from 1.3 to 2.3, and a ratio of the width of the outer arm to the thickness of the outer arm range from 1.3 to 2.3.

7. The card edge connector of claim 1, wherein the contact portion has a contact edge and a guide edge, the guide edge is positioned above the contact edge, wherein the plurality of flat plate-shaped terminals comprise a first row of flat plate-shaped terminals and a second row of flat plate-shaped terminal, each flat plate-shaped terminal of the first row is mounted in each terminal groove of the first wall body, each flat plate-shaped terminal of the second row is mount in each terminal groove of the second wall body, wherein a height of the contact portion of each flat plate-shaped terminal of the first row is lower than a height of the contact portion of each flat plate-shaped terminal of the second row, wherein a sharp angle between the guide edge of each flat plate-shaped terminal of the first row and the up-down direction is larger than a sharp angle between the guide edge of each flat plate-shaped terminal of the second row and the up-down direction, and wherein the width of the upper reverse bent section of the inner arm of each flat plate-shaped terminal of the first row is larger than the width of the upper reverse bent section of the inner arm of each flat plate-shaped terminal of the second row.

8. The card edge connector of claim 7, wherein the width of the inward inclined arm section of the inner arm of each flat plate-shaped terminal of the second row is larger than the width of the inward inclined arm section of the inner arm of each flat plate-shaped terminal of the first row, wherein the width of the inward inclined arm section of the outer arm of each flat plate-shaped terminal of the first row is equal to the width of the upper reverse bent section of the outer arm of each flat plate-shaped terminal of the first tow, the width of the inward inclined arm section of the outer arm of each flat plate-shaped terminal of the second row is equal to the width of the upper reverse bent section of the outer arm of each flat plate-shaped terminal of the second row, the width of the inward inclined arm section of the outer arm of each flat plate-shaped terminal of the first row is larger than the width of the inward inclined arm section of the outer arm of each flat plate-shaped terminal of the second row, wherein the width of the outward inclined arm section of the inner arm of each flat plate-shaped terminal of the first row is larger than or equal to the width of the outward inclined arm section of the inner arm of each flat plate-shaped terminal of the second row, wherein the width of the lower reverse bent section of the outer arm of each flat plate-shaped terminal of the first row, the width of the lower reverse bent section of the inner arm of each flat plate-shaped terminal of the first row, the width of the lower reverse bent section of the outer arm of each flat plate-shaped terminal of the second row, the width of the lower reverse bent section of the inner arm of each flat plate-shaped terminal of the second row, the width of the outward inclined arm section of the outer arm of each flat plate-shaped terminal of the first row, the width of the outward inclined arm section of the outer arm of each flat plate-shaped terminal of the second row and the width of the outward inclined arm section of the inner arm of each flat plate-shaped terminal of the second row are equal to each other.

9. The card edge connector of claim 8, wherein in each flat plate-shaped terminal of the first row:

the width of the upper reverse bent section of the inner arm is larger than the width of the upper reverse bent section of the outer arm, the width of the inward inclined arm section of the inner arm is equal to the width of the inward inclined arm section of the outer arm, the width of the outward inclined arm section of the inner arm is larger than or equal to the width of the outward inclined arm section of the outer arm, the width of the lower reverse bent section of the inner arm is equal to the width of the lower reverse bent section of the outer arm, the width of the upper reverse bent section of the inner arm is larger than the width of the inward inclined arm section of the inner arm, the width of the inward inclined arm section of the inner arm is larger than or equal to the width of the outward inclined arm section of the inner arm, the width of the outward inclined arm section of the inner arm is larger than or equal to the width of the lower reverse bent section of the inner arm, the width of the upper reverse bent section of the outer arm is equal to the width of the inward inclined arm section of the outer arm, the width of the inward inclined arm section of the outer arm is larger than the width of the outward inclined arm section of the outer arm, the width of the outward inclined arm section of the outer arm is equal to the width of the lower reverse bent section of the outer arm, the ratio of the width of the inner arm to the thickness of the inner arm and the ratio of the width of the outer arm to the thickness of the outer arm each range from 1.3 to 2.3, wherein in each flat plate-shaped terminal of the second row:

the width of the upper reverse bent section of the inner arm is larger than the width of the upper reverse bent section of the outer arm, the width of the inward inclined arm section of the inner arm is larger than the width of the inward inclined arm section of the outer arm, the width of the outward inclined arm section of the inner arm is equal to the width of the outward inclined arm section of the outer arm, the width of the lower reverse bent section of the inner arm equal to the width of the lower reverse bent section of the outer arm, the width of the upper reverse bent section of the inner arm is equal to the width of the inward inclined arm section of the inner arm, the width of the inward inclined arm section of the inner arm is larger than the width of the outward inclined arm section of the inner arm, the width of the outward inclined arm section of the inner arm is equal to the width of the lower reverse bent section of the inner arm, the width of the upper reverse bent section of the outer arm is equal to the width of the inward inclined arm section of the outer arm, the width of the inward inclined arm section of the outer arm is equal to the width of the outward inclined arm section of the outer arm, the width of the outward inclined arm section of the outer arm is equal to the width of the lower reverse bent section of the outer arm, the ratio of the width of the inner arm to the thickness of the inner arm and the ratio of the width of the outer arm to the thickness of the outer arm each range from 1.3 to 2.0.

10. The card edge connector of claim 1, wherein each flat plate-shaped terminal further comprises a holding portion, the holding portion is configured to be interference fixed with the insulating housing.

11. The card edge connector of claim 10, wherein the holding portion is integrally formed with the flat plate-shaped terminal.

12. The card edge connector of claim 10, wherein the card edge connector further comprises a plurality of support blocks, each support block is positioned between the base portion and the holding portion, wherein each terminal groove further comprises a support block receiving groove, the support block receiving grooves are communicated with each other, the support blocks are arranged side by side along with longitudinal direction in the support block receiving grooves which are communicated with each other.

13. The card edge connector of claim 12, wherein the holding portion further comprises an interference protrusion, and wherein each support block receiving groove further comprises a shallow groove, the interference protrusion is interference fixed with the shallow groove.

14. The card edge connector of claim 13, wherein each flat plate-shaped terminal further comprises a tail portion, the insulating housing further comprises a plurality of terminal tail portions fixing grooves, the terminal tail portion fixing groove is configured to position and receive the tail portion of the flat plate-shaped terminal.

15. The card edge connector of claim 7, wherein an upper end of an inside of the first wall body has an inclined insertion guiding surface toward the card edge inserting groove.

* * * * *